US007215106B2

(12) United States Patent
Sato

(10) Patent No.: US 7,215,106 B2
(45) Date of Patent: May 8, 2007

(54) POWER SUPPLY CONTROL CIRCUIT, ELECTRONIC DEVICE, AND PRINTING APPARATUS

(75) Inventor: Takashi Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/529,230

(22) Filed: Sep. 29, 2006

(65) Prior Publication Data

US 2007/0080977 A1 Apr. 12, 2007

(30) Foreign Application Priority Data

Oct. 7, 2005 (JP) ..... 2005-295551

(51) Int. Cl.
*G05F 1/40* (2006.01)

(52) U.S. Cl. ..... 323/282

(58) Field of Classification Search ..... 323/273, 323/274, 275, 276, 282, 283, 285; 361/91.1
See application file for complete search history.

(56) References Cited

U.S. PATENT DOCUMENTS 4,967,133 A * 10/1990 Hasegawa ..... 318/798
5,559,376 A 9/1996 Tachikawa ..... 307/86
6,201,375 B1 * 3/2001 Larson et al. ..... 323/277
6,831,449 B2 * 12/2004 Nishida et al. ..... 323/284
6,987,379 B2 * 1/2006 Peron ..... 323/225
2005/0135132 A1 * 6/2005 Masuda ..... 363/142

FOREIGN PATENT DOCUMENTS

JP 05-204496 8/1993
JP 2000-188829 7/2000

* cited by examiner

*Primary Examiner*—Adolf Berhane
(74) *Attorney, Agent, or Firm*—Fitzpatrick, Cella, Harper & Scinto

(57) ABSTRACT

A power supply control circuit for controlling a power supply circuit having a DC/DC converter is provided. A discharge circuit operates based on a discharge instruction signal for instructing discharge and uses a switching element to remove charges of a capacitor connected to an output terminal of the DC/DC converter. An overvoltage detecting circuit outputs a detection signal when a potential at the output terminal of the DC/DC converter exceeds a predetermined potential. A level conversion circuit outputs a signal obtained by converting a potential applied to the switching element of the discharge circuit. A logic circuit performs a logic operation between an inverted signal of a start-up signal, the detection signal, and the signal obtained by converting the potential, and outputs a failure detection signal representing a failed state of the power supply circuit.

9 Claims, 8 Drawing Sheets

FIG. 5

OUTPUT LOGIC OF LEVEL CONVERSION CIRCUIT 13
IN NORMAL OPERATION

| DCHGX | VH | VHs |
|---|---|---|
| L | H | L |
| H | L | H |

FIG. 6A

TRUTH TABLE OF LOGIC CIRCUIT (VHover SIGNAL: H)

| DCHGX | VHs | PS_ERR | |
|---|---|---|---|
| L | L | H | (1) NORMALITY DETERMINATION UPON ENB_ON |
| L | H | L | (2) FAILURE DETERMINATION UPON ENB_ON |
| H | L | L | (3) FAILURE DETERMINATION UPON ENB_OFF |
| H | H | H | (4) NORMALITY DETERMINATION UPON ENB_OFF |

FIG. 6B

TRUTH TABLE OF LOGIC CIRCUIT (VHover SIGNAL: L)

| DCHGX | VHs | PS_ERR | |
|---|---|---|---|
| L | L | L | (5) OVERVOLTAGE STATE |
| L | H | L | (6) OVERVOLTAGE STATE OR FAILURE DETERMINATION UPON ENB_ON |
| H | L | L | (7) OVERVOLTAGE STATE OR FAILURE DETERMINATION UPON ENB_OFF |
| H | H | L | (8) OVERVOLTAGE STATE |

POWER SUPPLY CONTROL CIRCUIT, ELECTRONIC DEVICE, AND PRINTING APPARATUS

BACKGROUND OF THE INVENTION

1. Field of the Invention

The present invention relates to a power supply control circuit, electronic device, and printing apparatus and, more specifically, to detection of a failure in a power supply circuit having a DC/DC converter.

2. Description of the Related Art

In general, OA equipment having a mechanical part, such as a copying machine or printer, requires at least two types of power supplies having different voltages: a power supply (power supply for generating logic voltages of, e.g., +5 V and +3.3 V) for a logic circuit system for controlling the equipment and a power supply (power supply for generating driving voltages of, e.g., +24 V and +20 V) for a mechanism driving system.

Of the two types of power supplies, the power supply of the driving system must ensure safety for a serviceman and user in maintenance of a driving system component, and save power when the equipment stands by. To meet these requirements, the power supply voltage of the driving system needs a switch for switching the connection state, and must rise and fall in accordance with a specified sequence.

Driving of the equipment upon generation of a state such as an overvoltage in the power supply may deteriorate a driven portion or cause a failure. Thus, driving of the equipment must be avoided upon generation of an overvoltage in the power supply.

The above-mentioned overvoltage is a typical failure of the power supply output. To avoid such an anomaly, a conventional power supply control system suppresses, to a minimum time, a state in which the power supply sequence reverses upon generation of an anomalous output voltage (low voltage or overvoltage) from the power supply unit, or decreases the generation frequency of this state. This measure can avoid malfunction of a logic circuit for driving a load, or prevent deterioration and failure of the load.

For example, Japanese Patent Laid-Open No. 5-204496 discloses a method of turning off the power supply in correspondence with a power supply anomaly signal transmitted from a power supply unit in an arrangement having a plurality of power supply units. According to the method described in Japanese Patent Laid-Open No. 5-204496, at the same time as detection of a power supply anomaly signal, a power supply OFF signal is transmitted to a power supply unit which generated a power supply anomaly and a power supply unit equal to or higher than the anomalous power supply unit in output voltage. A power supply OFF signal is transmitted in accordance with a predetermined power-off sequence to a power supply unit lower in output voltage than the power supply unit which generated the power supply anomaly.

Japanese Patent Laid-Open No. 2000-188829 discloses a method of, when an anomaly occurs in the power supply sequence of a power supply unit, specifying a doubtful power supply unit and clearing up the cause of an operation error by the anomaly of the power supply sequence. According to the method described in Japanese Patent Laid-Open No. 2000-188829, the output power supply voltage of each power supply unit is compared with a specified value at the timing of rising of a power supply output. A doubtful power supply unit is specified on the basis of a logic signal representing the comparison result.

Both the methods described in Japanese Patent Laid-Open Nos. 5-204496 and 2000-188829 detect an anomaly in a power supply sequence when the voltage rises, but do not detect any anomaly in a power supply sequence when the voltage falls.

As for a device requiring periodic exchange of expendables and periodic maintenance, like OA equipment, it is also important to ensure safety in maintenance in addition to preventing deterioration and failure of the load. That is, it is necessary to ensure safety for a serviceman and user when performing maintenance or exchanging expendables. To meet this demand, the power supply voltage must reliably fall to GND level in a falling (power supply-off) sequence, and a generated failure must be detected.

SUMMARY OF THE INVENTION

In view of the above problems in the conventional art, the present invention has an object to allow detecting a failure in a power supply device having a DC/DC converter regardless of the start-up state of the DC/DC converter.

According to one aspect of the present invention, a power supply control circuit for controlling a power supply circuit having a DC/DC converter is provided. A discharge circuit operates based on a discharge instruction signal for instructing discharge and uses a switching element to remove charges of a capacitor connected to an output terminal of the DC/DC converter. An overvoltage detecting circuit outputs a detection signal when a potential at the output terminal of the DC/DC converter exceeds a predetermined potential. A level conversion circuit outputs a signal obtained by converting a potential applied to the switching element of the discharge circuit. A logic circuit performs a logic operation between an inverted signal of a start-up signal, the detection signal, and the signal obtained by converting the potential, and outputs a failure detection signal representing a failed state of the power supply circuit.

Further features of the present invention will become apparent from the following description of exemplary embodiments (with reference to the attached drawings).

BRIEF DESCRIPTION OF THE DRAWINGS

FIG. 5 is a table showing the truth table of a level conversion circuit in the embodiment of the present invention;

FIGS. 6A and 6B are tables each showing the truth table of a logic circuit in the embodiment of the present invention;

DESCRIPTION OF THE EMBODIMENTS

Preferred embodiments of the present invention will be described in detail in accordance with the accompanying drawings. The present invention is not limited by the disclosure of the embodiments and all combinations of the features described in the embodiments are not always indispensable to solving means of the present invention.

Figure 1:
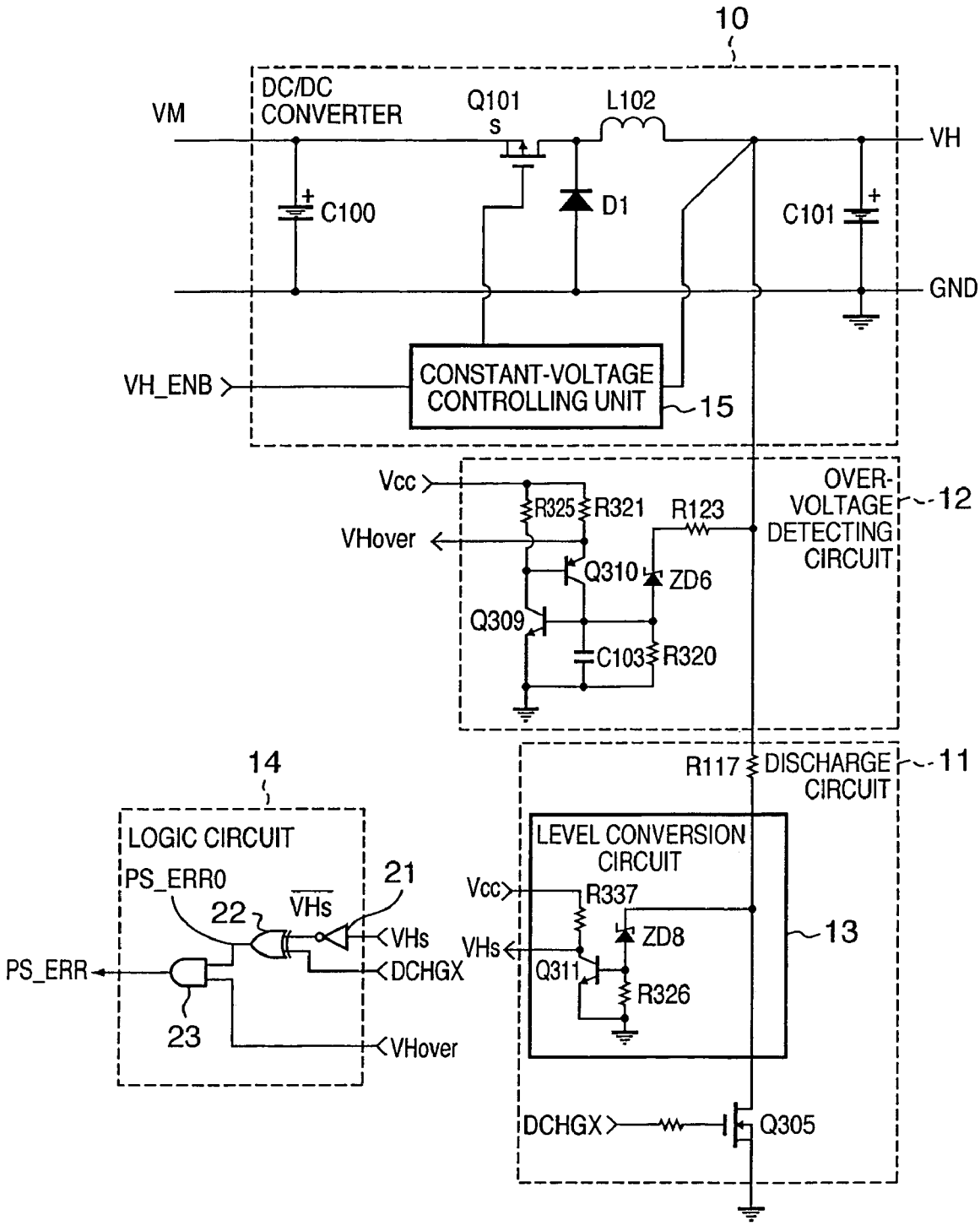
FIG. 1 is a circuit diagram of a power supply control circuit in an embodiment of the present invention.

FIG. 1 is a circuit diagram showing a power supply control circuit according to the embodiment of the present invention. The power supply control circuit in the embodiment comprises, as a power supply circuit, a DC/DC converter 10 which converts an input DC voltage into a desired DC voltage. The power supply control circuit also comprises an overvoltage detecting circuit 12 which detects that the output voltage of the DC/DC converter 10 reaches a predetermined voltage or more, a discharge circuit 11 which removes charges accumulated in the output capacitor of the DC/DC converter, and a logic circuit (error detecting circuit for the power supply control circuit) 14.

The DC/DC converter 10 is, e.g., a step-down (drop-down) DC/DC converter. The DC/DC converter 10 lowers a DC input voltage VM applied from the AC/DC converter of a power supply unit (650 in FIG. 8) to a DC output voltage VH and outputs the DC output voltage VH. Reference symbol C100 denotes a smoothing capacitor; and Q101, an input switching element. The switching element Q101 and a diode D1 convert an output voltage. An inductor L102 and capacitor C101 operate as an output smoothing filter.

The DC/DC converter 10 in the embodiment uses a constant-voltage controlling unit 15 to compare by an error amplifier the difference between a reference voltage Vref (not shown) and the value of the output voltage VH appearing across the capacitor C101 and execute feedback control so as to eliminate the error. The control method is generally known PWM constant-voltage control.

A VH_ENB signal permits the constant-voltage controlling unit 15 to operate. The constant-voltage controlling unit 15 receives a active-high VH_ENB signal. The DC/DC converter is turned on when the VH_ENB signal changes to high level (e.g., 3.3 V), and off when the VH_ENB signal changes to low level (e.g., 0 V). The controlling unit of the electronic device outputs the VH_ENB signal.

The discharge circuit 11 removes charges accumulated in the output capacitor when the DC/DC converter 10 stops operating, and is inserted between the output of the DC/DC converter 10 and GND. The discharge circuit 11 has a switching element Q305 and resistor R117, and incorporates a level conversion circuit 13 which detects a potential at the node between the switching element Q305 and the resistor R117.

The switching element Q305 is a MOSFET having a source connected to GND and a drain terminal connected to the resistor R117. The other terminal of the resistor R117 connects to the output terminal VH of the DC/DC converter 10. The controlling unit of the electronic device outputs a discharge instruction signal (DCHGX signal) to the gate terminal of the MOSFET Q305 via the resistor. The DCHGX signal may be generated by inverting, e.g., the VH_ENB signal.

The level conversion circuit 13 connects to the drain terminal potential of the switching element Q305, and detects a VH voltage via the resistor R117. The level conversion circuit 13 has a Zener diode ZD8, transistor Q311, resistor R326, and resistor R337, and receives Vcc (e.g., 3.3 V) from a power supply unit (not shown) as a signal potential. The cathode of the Zener diode ZD8 connects to the drain node between the resistor R117 and switching element Q305 of the discharge circuit 11. The anode of the Zener diode ZD8 connects to one terminal of the resistor R326 and the base of the transistor Q311. The other terminal of the resistor R326 and the emitter of the transistor Q311 connect to GND, and the collector of the transistor Q311 connects to Vcc via the pull-up resistor R337. The logic circuit 14 receives the collector terminal potential of the transistor Q311 as a VHs signal. The logic circuit 14 outputs a signal associated with generation of an error in the power supply control circuit.

The overvoltage detecting circuit 12 has a latch structure to detect that the output voltage of the DC/DC converter 10 reaches a desired voltage or more. The overvoltage detecting circuit 12 has a Zener diode ZD6, resistors R123, R320, R321, and R325, transistors Q309 and Q310, and a capacitor C103. The overvoltage detecting circuit 12 receives a signal potential. Vcc (e.g., 3.3 V) from a power supply unit (not shown).

One terminal of the resistor R123 connects to the output terminal VH of the DC/DC converter 10, and the other terminal connects to the cathode of the Zener diode ZD6. The anode of the Zener diode ZD6 connects to the base of the transistor Q309 and the collector of the transistor Q310 which connect to one terminal of the resistor R320 and one terminal of the capacitor C103 with a latch structure. The other terminal of the resistor R320, the other terminal of the capacitor C103, and the emitter of the transistor Q309 connect to GND.

The base of the transistor Q310 and the collector of the transistor Q309 connect to Vcc via the pull-up resistor R325, and the emitter of the transistor Q310 connects to Vcc via the pull-up resistor R321. The overvoltage detecting circuit 12 outputs a signal from the emitter terminal of the transistor Q310 as a detection signal VHover of the overvoltage detecting circuit to the logic circuit 14.

The logic circuit 14 receives the DCHGX signal, the VHs signal and the VHover signal. The discharge circuit 11 receives the DCHGX signal from the controlling unit of the electronic device. The VHs signal is output from the level conversion circuit 13, and the VHover signal is output from the overvoltage detecting circuit 12. The logic circuit 14 detects, as failures, a power supply sequence error serving as an output anomaly of the DC/DC converter 10, and an output overvoltage at which the VH output reaches a desired voltage or more, and notifies the device controlling unit of a failure by a PS_ERR signal.

The logic circuit 14 comprises a NOT circuit 21, XOR circuit 22, and AND circuit 23. The input terminal of the NOT circuit 21 receives the VHs signal. One of two input terminals of the XOR circuit 22 receives an output from the NOT circuit 21, and the other input terminal of the XOR circuit 22 receives the DCHGX signal. One of two input terminals of the AND circuit 23 receives an output from the XOR circuit 22, and the other input terminal of the AND circuit 23 receives the VHover signal. The device controlling unit (not shown) receives an output from the AND circuit 23 as the PS_ERR signal.

The operation of each block in the power supply control circuit according to the embodiment will be described.

As described above, the discharge circuit 11 operates by the DCHGX signal as an inverted signal of the VH_ENB signal for turning on/off the DC/DC converter 10. More specifically, when the VH_ENB signal is at low level, the DC/DC converter 10 is inactive, the DCHGX signal is at high level, and the switching element Q305 of the discharge circuit 11 is ON. The discharge circuit 11 removes charges accumulated in the output capacitor C101 of the DC/DC converter 10 to GND via the resistor R117. To the contrary, when the VH_ENB signal is at high level, the DC/DC converter 10 operates to apply a predetermined voltage to the load, the DCHGX signal is at low level, and the switching element Q305 of the discharge circuit 11 is OFF. The discharge circuit 11 does not remove any charge.

The level conversion circuit 13 determines a detection potential by the resistor R326 inserted between the Zener diode ZD8 and the base-emitter path of the transistor Q311. The detection level VHd has a relation: VHd<VH with the output potential VH of the DC/DC converter 10.

When the VH_ENB signal is at high level, the Zener diode ZD8 is ON because the DC/DC converter 10 is active and the discharge circuit 11 is inactive. To turn on the transistor Q311, the VHs signal serving as the collector potential of the transistor Q311 changes to low level.

When the VH_ENB signal is at low level, the drain terminal of the switching element Q305 is at GND level because the DC/DC converter 10 is inactive and the switching element Q305 of the discharge circuit 11 is ON. Thus, the Zener diode ZD8 and transistor Q311 of the level conversion circuit 13 do not electrically connect to each other, and the VHs signal changes to a high-level (Vcc) potential via the pull-up resistor R337.

FIG. 5 is a table showing the logic state of the signal VHs output from the level conversion circuit 13 in association with the DCHGX signal and a VH signal representing the output level of the DC/DC converter 10. The VHs signal is at low level when the DC/DC converter 10 is active (VH is at high level) and the discharge circuit 11 is inactive (DCHGX is at low level). The VHs signal is at high level when the DC/DC converter 10 is inactive (VH is at low level) and the discharge circuit 11 is active (DCHGX is at high level).

That is, when the DCHGX signal and VHs signal are in phase, the discharge circuit 11 operates normally.

The operation of the overvoltage detecting circuit 12 will be explained. The overvoltage detecting circuit 12 detects that the output potential of the DC/DC converter 10 exceeds the desired potential VH. The resistors R320 and R123 and the Zener diode ZD6 determine a detection level VHod. The detection level VHod is set to a relation: VHod>VH with the set output potential VH of the DC/DC converter 10.

Typical errors which increase an output from the DC/DC converter to be equal to or higher than a set voltage are a short circuit between the drain and source of the MOSFET Q101 of the DC/DC converter 10, and an opening failure of the feedback loop for feedback to the constant-voltage controlling unit 15. In this case, duty control of the MOSFET Q101 becomes 100%, and the output potential VH of the DC/DC converter rises to the input voltage VM at maximum. For this reason, the detection level VHod of the overvoltage detecting circuit 12 is generally set to VM>VHod>VH.

More specifically, if the output potential of the DC/DC converter 10 exceeds the detection voltage VHod, the Zener diode ZD6 is turned on and the potential across the resistor R320 exceeds the VBE potential of the transistor Q309. Then, the transistors Q309 and Q310 connected to the latch structure are turned on. The VHover signal input to the emitter terminal of the transistor Q310 becomes almost equal to the VBE potential of the transistor Q309, and the VHover signal changes to low level. The above structure causes the VHover signal to maintain low level when the output potential of the DC/DC converter 10 exceeds the detection voltage VHod.

Hence, the overvoltage detecting circuit 12 does not operate, i.e., the VHover signal changes to high level in a normal operation in which VH_ENB is at H level and an output from the DC/DC converter 10 is equal to or lower than VHod, and in a state in which VH_ENB is at low level and the DC/DC converter 10 does not supply any output.

The operation of the logic circuit 14 will be described. The NOT circuit 21 inverts the VHs signal output from the level conversion circuit 13. One input terminal of the XOR circuit 22 receives the inverted signal to perform a logic operation between the inverted signal and the DCHGX signal input to the other input terminal of the XOR circuit 22. The input terminal of the AND circuit 23 receives a signal (PS_ERR0) output from the XOR circuit 22 and the VHover signal output from the overvoltage detecting circuit 12, outputting the PS_ERR signal as an AND operation result to the device controlling unit.

More specifically, the logic circuit 14 determines the output state of the discharge circuit 11 by a logic operation between the DCHGX signal and the VHs signal. The logic circuit 14 ANDs the determination result of the output state of the discharge circuit 11 and the VHover signal of the overvoltage detecting circuit 12, and thereby outputs, to the device controlling unit, the PS_ERR signal representing whether the output state of the DC/DC converter 10 is anomalous.

The signal VHover output from the overvoltage detecting circuit 12 is an output from the latch structure, so the VHover signal keeps low level when an output from the DC/DC converter 10 changes to an overvoltage state higher than VHod. The VHover signal is ANDed with the output state of the discharge circuit 11 obtained by a logic operation between VHs and the DCHGX signal. For this reason, the logic circuit 14 can transmit a failure of the discharge circuit 11 and the output overvoltage state of the DC/DC converter 10 by only the PS_ERR signal. Upon generation of a failure, the logic circuit 14 outputs a low-level signal to the device controlling unit.

FIGS. 6A and 6B show the truth table of the logic circuit 14 according to the embodiment. FIG. 6A shows the truth table of the logic circuit 14 when the VHover signal is at high level. FIG. 6B shows the truth table of the logic circuit 14 when the VHover signal is at low level.

Operations of the power supply control circuit in a normal state and upon generation of an error will be explained with reference to the sequence charts of FIGS. 2 and 3.

Figure 2:
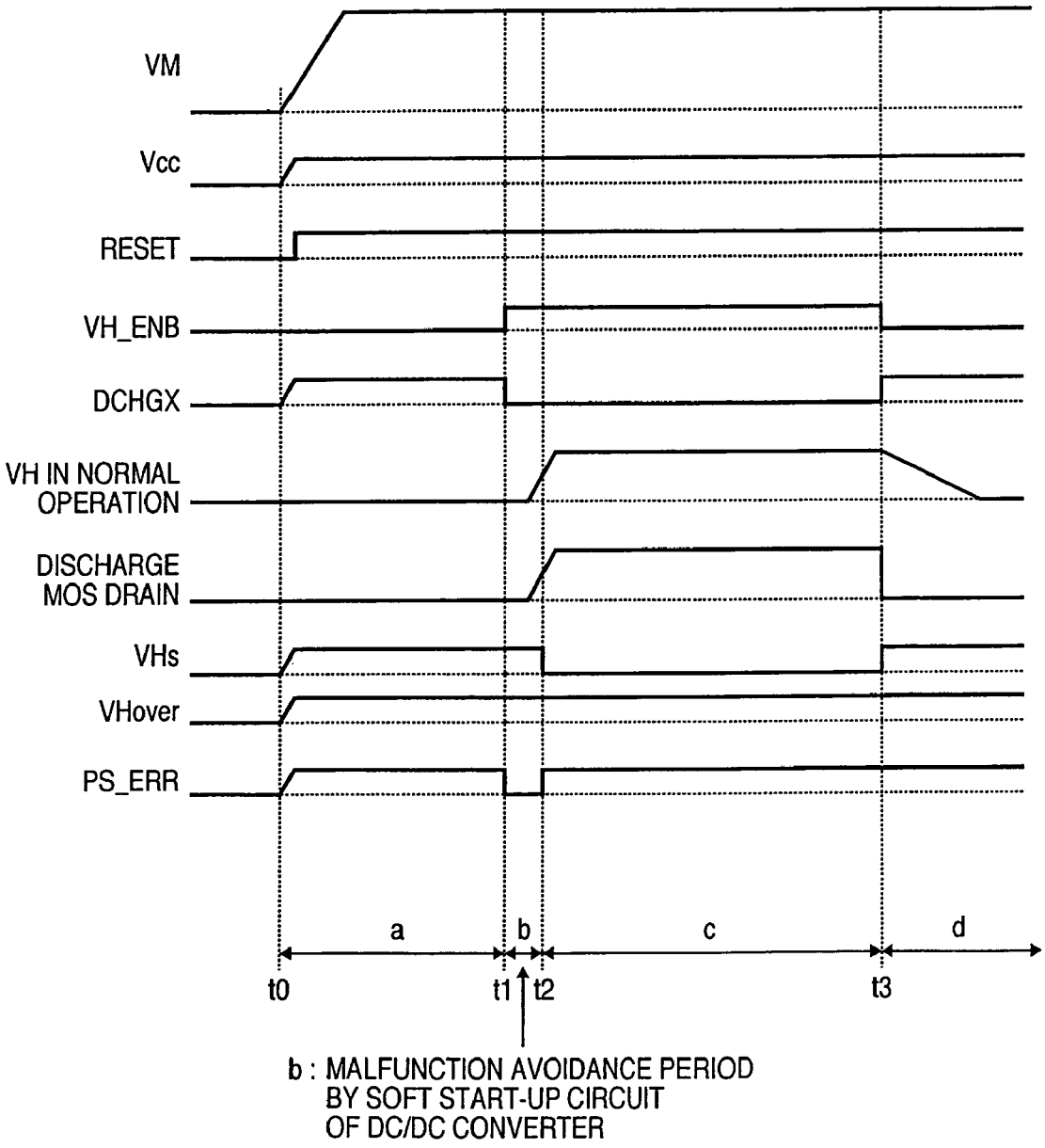
FIG. 2 is a sequence chart showing the states of respective signals in a normal operation in the embodiment of the present invention.

FIG. 2 is a sequence chart showing a power supply sequence in a normal operation and the states of signals at respective portions. Upon turning on the whole device (not shown) (t0), the VM output serving as an input to the DC/DC converter and the Vcc voltage for device control logic rise. Then, the RESET signal for resetting device control and the DCHGX signal rise.

In the period a, to normally operate the DC/DC converter 10 at a low-level VH_ENB signal, the DCHGX signal changes to high level to turn on the discharge MOS Q305. Since the detection point of the level conversion circuit 13 is GND level, the VHs signal as a signal output from the level conversion circuit 13 changes to high level. Since the VHover signal is at low level, the PS_ERR signal changes to high level.

At the timing t1 in FIG. 2, VH_ENB changes to high level and the DCHGX signal changes to low level. Then, the DC/DC converter 10 starts operating, and the VH output and the drain potential of the discharge MOS Q305 rise along with start-up.

In general, a soft start-up circuit for gradually activating the DC/DC converter 10 is assembled to reduce stress applied to an element by an inrush current in activating the switching element Q101. The PS_ERR signal keeps low level, which is detected as a failure, until the potential at the drain node between the resistor R117 and the discharge MOS Q305 serving as the detection point of the level conversion circuit rises to the detection level VHd. However, this state is known in advance, so the device controlling unit can ignore the PS_ERR signal by, e.g., a masking process without any problem during the period b between t1 and t2 until the VH potential exceeds the VHd level.

Since the output VHs of the level conversion circuit changes to low level at the timing t2 when the VH output exceeds VHd, the PS_ERR signal changes to high level representing a normal operation at the timing t2.

At the timing t3, the DC/DC converter 10 stops operating. At the timing t3, the VH_ENB signal changes to low level, and the DCHGX signal changes to high level, turning on the MOS Q305 of the discharge circuit. The drain terminal changes to GND level, the Zener diode ZD8 of the level conversion circuit is turned off, and the VHs signal serving as an output from the level conversion circuit 13 also changes to high level. As a result, the PS_ERR signal maintains high level representing a normal operation.

In this manner, no failure is detected in a normal operation by, e.g., inserting a 20-msec mask process to ignore the PS_ERR signal during the soft start-up period (b) that acts in activating the DC/DC converter 10.

Figure 3:
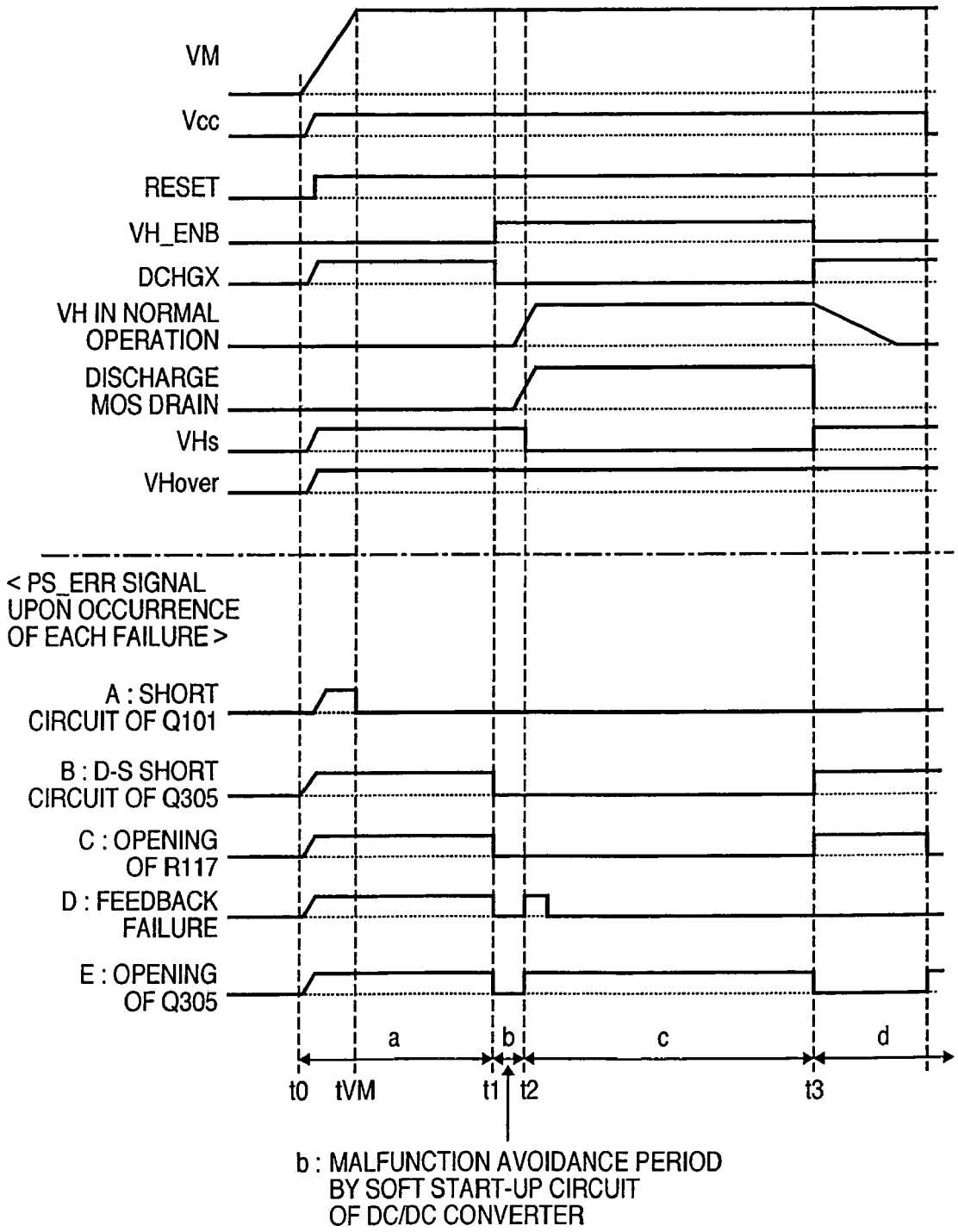
FIG. 3 is a sequence chart showing the states of respective signals upon generation of a failure in the embodiment of the present invention.

FIG. 3 is a sequence chart showing a power supply sequence upon generation of an error and the states of signals at respective portions. For reference, upper part of FIG. 3 shows the same nine waveforms as signal waveforms in a normal operation. As examples of a failure and error, states upon generation of five failures shown in lower part of FIG. 3 will be explained.

A: Short Circuit Between Drain and Source of Q101

In this case, the input voltage VM is directly output via the inductor L102 because the drain and source of the sole switching element Q101 present between the input and output of the DC/DC converter 10 short-circuit.

Upon turning on the whole device at t0, the VM output serving as an input to the DC/DC converter and the Vcc voltage for device control logic rise. The RESET signal for resetting device control and the DCHGX signal rise.

Since the drain and source of the switching element Q101 short-circuit, the VM potential is output to the output of the DC/DC converter 10 regardless of control of the DC/DC converter 10. The signal VHover output from the overvoltage detecting circuit 12 is latched at low level, and the output PS_ERR from the logic circuit 14 changes to low level, detecting a failure.

This error is detected during all the period after the rise of VM (after tVM). Although reduction of VM and voltages at portions necessary for maintenance is impossible, the power supply control circuit can take a measure to, for example, display a message to call attention of a serviceman and user.

In an inkjet printer or the like, the carriage moves from a home position to an ink exchange position when exchanging an expendable ink tank. In this case, an error message "please ask the manufacturer to repair the printer." is displayed.

The embodiment can easily ensure safety because an error message can be kept output until the main power supply of the device is turned off because the overvoltage detection signal VHover has the latch structure.

This example assumes a case where the drain and source of the switching element Q101 short-circuit before start-up. Even when a short-circuit failure occurs during an operation, the AND circuit 23 recognizes detection of an overvoltage from a latch signal to quickly detect a failure at any timing.

B: Short Circuit Between Drain and Source of Discharge MOS Q305

In this case, the drain of the discharge MOS Q305 is always at GND level even at the timing t1 when the VH_ENB signal changes to high level and the DCHGX signal changes to low level in accordance with the sequence. Thus, the DCHGX signal changes to low level, the VHs signal changes to high level, and the PS_ERR signal changes to low level. As a result, a failure can be detected after the period b between t1 and t2, substantially at the timing t2 or subsequent timing after the soft start-up time of the DC/DC converter 10.

Note that this failure is detected as (6) a failure upon ENB_ON in FIG. 6B.

C: Opening Failure of Resistor R117

In this case, the DC/DC converter 10 starts operating normally, but the discharge circuit 11 does not receive any VH potential at the timing t1 when the VH_ENB signal changes to high level and the DCHGX signal changes to low level in accordance with the sequence. Thus, the level conversion circuit 13 and the drain terminal of the discharge MOSFET do not receive any potential. After the period b between t1 and t2, substantially after the timing t2 after the soft start-up of the DC/DC converter 10, the DCHGX signal changes to low level, the VHs signal changes to high level, and the PS_ERR signal changes to low level.

Note that this failure is detected as (2) a failure upon ENB_ON in FIG. 6A. If an overvoltage is also generated, this failure is detected as (6) a failure upon ENB_ON in FIG. 6B.

D: Opening Error of Constant-Voltage Feedback Loop (Feedback Error)

In this case, the DC/DC converter 10 starts operating normally at the timing t1 when the VH_ENB signal changes to high level and the DCHGX signal changes to low level in accordance with the sequence. However, feedback control of a constant voltage does not act (opening error). In other words, the constant-voltage controlling unit 15 of the DC/DC converter 10 does not function, and the output voltage VH exceeds a desired VH voltage.

The signal VHover output from the overvoltage detecting circuit 12 is latched at low level, and the output PS_ERR from the logic circuit 14 changes to low level, detecting a failure.

This example describes a case where an opening error occurs as a feedback failure before start-up. Even when an opening error occurs during an operation, the AND circuit 23 recognizes detection of an overvoltage from a latch signal to quickly detect a failure at any timing.

E: Opening Failure in Drain-Source Path of Discharge MOS Q305

In this case, the DC/DC converter 10 stops operating and the discharge circuit 11 starts a discharge operation at the timing when the VH_ENB signal switches from high level to low level and the DCHGX signal switches from low level to high level in accordance with the sequence. However, the drain-source path of the discharge MOS Q305 is open, so charges accumulated in the DC/DC converter 10 are not removed. The drain terminal of the discharge MOS Q305 receives a discharge potential for a very long time due to the internal impedance of the DC/DC converter 10. The output VHs of the level conversion circuit 13 maintains low level until the drain potential of the discharge MOS Q305 becomes lower than the VHd potential serving as the detection level of the level conversion circuit.

A failure is detected on the basis of PS_ERR after the timing t3 in the sequence of FIG. 3. This failure is detected as (7) a failure upon ENB_OFF in FIG. 6B.

Figure 4:
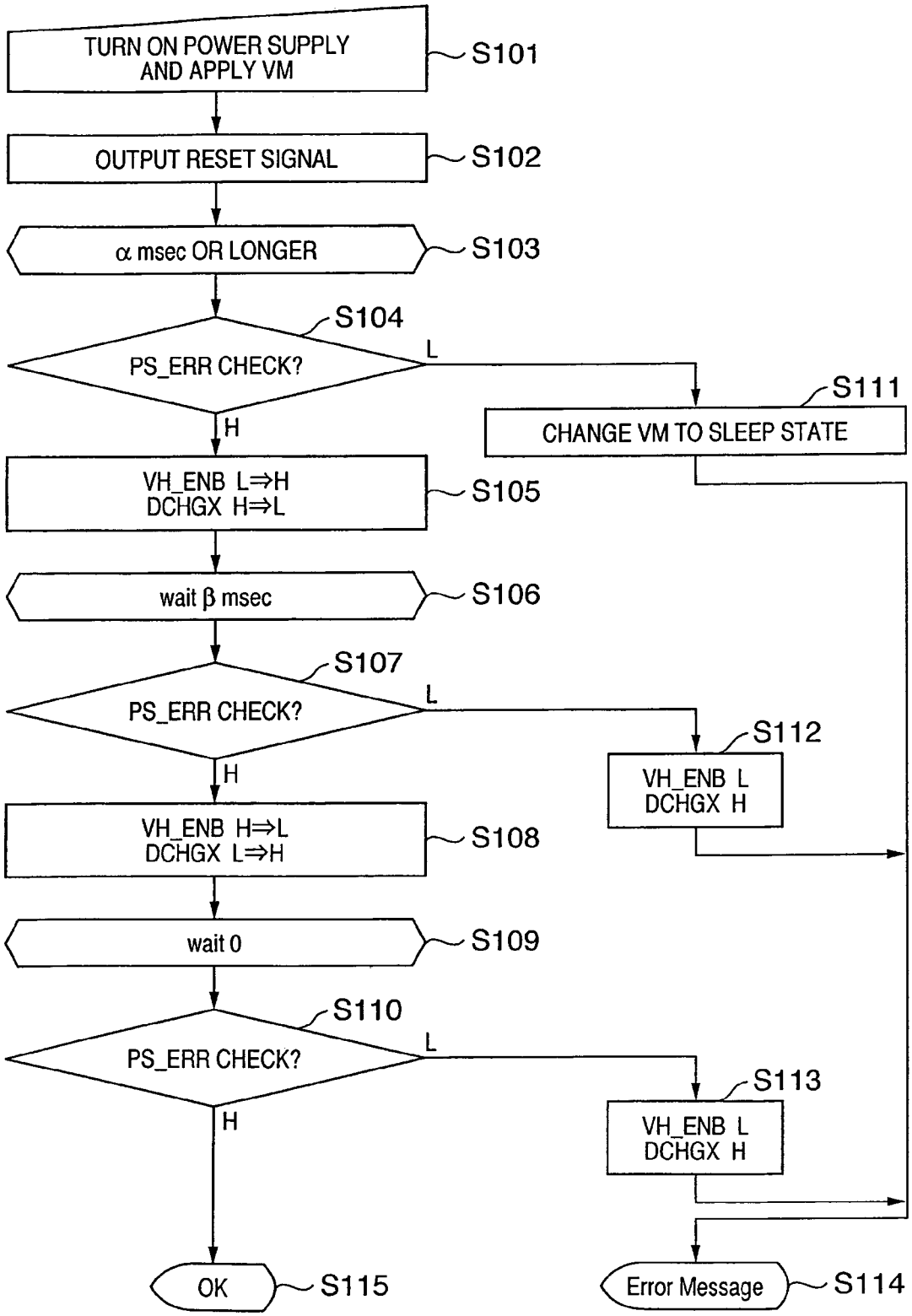
FIG. 4 is a flowchart of a failure detecting process in the embodiment of the present invention.

A failure detecting process according to the embodiment will be explained with reference to the flowchart of FIG. 4. The process shown in FIG. 4 includes a process performed by the power supply control circuit and also a process performed by the device controlling unit along with detection of a failure.

The overall apparatus is turned on. At the same time, the input voltage VM of the power supply control circuit rises (step S101). After a predetermined time, RESET rises as shown in FIGS. 2 and 3 (step S102). The process waits for a time (a msec) until VM reaches a predetermined voltage (step S103).

At this time, the state of the signal PS_ERR output from the logic circuit is checked (step S104). If the PS_ERR signal is at low-level, the apparatus changes to a sleep state so as to decrease the VM potential (step S111). The display of the apparatus outputs an error message (step S114), ending the process. A failure detected at this time is, e.g., (A) a short circuit between the drain and source of the switching element Q101.

If the PS_ERR signal is at high level in step S104, the VH_ENB signal changes to high level and the DCHGX signal changes to low level so as to activate the DC/DC converter (step S105). The process waits for the wait time (β msec) of a soft start-up process (step S106).

The state of the signal PS_ERR output from the logic circuit is checked again (step S107). If the PS_ERR signal is at low level, the VH_ENB signal switches to low level and the DCHGX signal switches to high level so as to stop the DC/DC converter and perform discharge by the discharge circuit (step S112). The display of the apparatus outputs an error message (step S114), ending the process. Failures detected at this time are, e.g., (B) a short circuit between the drain and source of the discharge MOS Q305, (C) an opening failure of the resistor R117, and (D) a feedback failure.

If the PS_ERR signal is at high level in step S107, the DC/DC converter keeps operating until the device controlling unit issues a DC/DC converter stop instruction. If the device controlling unit issues a DC/DC converter stop instruction, the VH_ENB signal switches to low level and the DCHGX signal switches to high level so as to stop the DC/DC converter and perform discharge by the discharge circuit (step S108). In this case, no wait process is done (0 wait time) (step S109), and the signal PS_ERR output from the logic circuit is checked again (step S110).

If the PS_ERR signal is at low level, the VH_ENB signal switches to low level and the DCHGX signal switches to high level so as to stop the DC/DC converter and perform discharge by the discharge circuit (step S113). The display of the apparatus outputs an error message (step S114), ending the process. A failure detected at this time is, e.g., (E) an opening failure in the drain-source path of the discharge MOS Q305.

If the PS_ERR signal is at high level in step S110, the state of the DC/DC converter is normal, and a normal end process is executed (step S115).

In the above description, a process upon detecting a failure in step S104 and a process upon detecting a failure in steps S107 and S110 are different from each other. However, the process upon detecting a failure is properly set in accordance with the apparatus arrangement. For example, VM may change to a sleep state upon detecting a failure. For a failure such as (E) an opening failure in the drain-source path of the discharge MOS Q305, the wait process may be adopted until a voltage applied to the output capacitor C101 of the DC/DC converter 10 drops.

<Concrete Example of Electronic Device>

Figure 7:
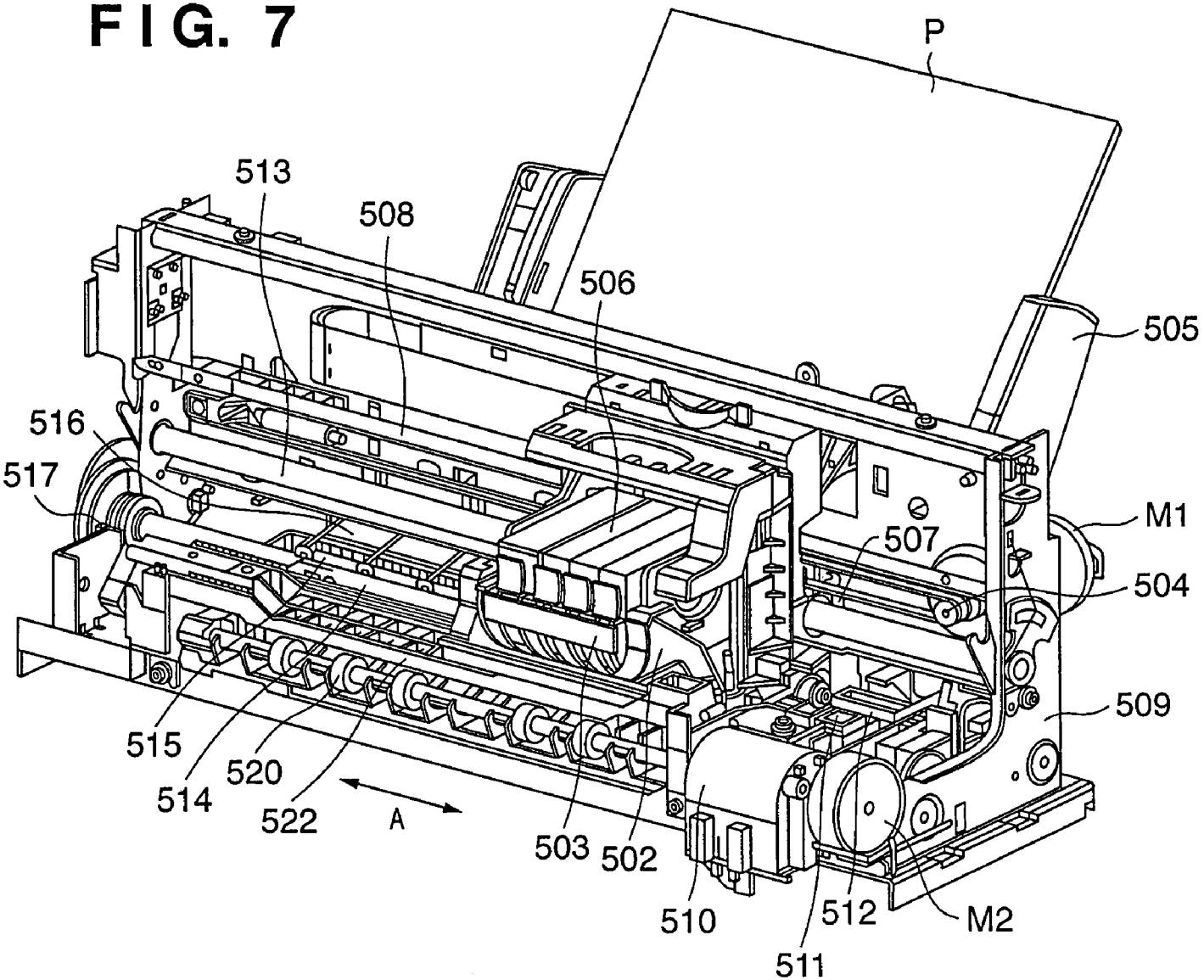
FIG. 7 is an outer perspective view showing the schematic structure of an inkjet printing apparatus to which the present invention is applied.

FIG. 7 is a perspective view showing the schematic outer structure of an inkjet printing apparatus as a typical example of an electronic device having the power supply control circuit according to the present invention.

In the inkjet printing apparatus (to be referred to as a printing apparatus hereinafter), as shown in FIG. 7, a transmission mechanism 504 transmits a driving force generated by a carriage motor M1 to a carriage 502 which supports a printhead 503 for printing by discharging ink according to the inkjet method. The driving force reciprocates the carriage 502 in a direction indicated by an arrow A, and supplies a printing medium P such as a printing sheet via a paper feed mechanism 505 and conveys it to a print position. At the print position, the printhead 503 discharges ink to the printing medium P to print.

In order to maintain a good state of the printhead 503, the carriage 502 moves to the position of a recovery device 510, which intermittently executes a discharge recovery operation for the printhead 503.

The carriage 502 of the printing apparatus supports not only the printhead 503, but also an ink cartridge 506 which stores ink to be supplied to the printhead 503. The ink cartridge 506 is detachable from the carriage 502. The carriage 502 further supports the power supply control circuit shown in FIG. 1.

The printing apparatus shown in FIG. 7 can print in color. For this purpose, the carriage 502 supports four ink cartridges which respectively store magenta (M), cyan (C), yellow (Y), and black (K) inks. The four ink cartridges are independently detachable.

The carriage 502 and printhead 503 can achieve and maintain a predetermined electrical connection by properly bringing their contact surfaces into contact with each other. The printhead 503 selectively discharges ink from a plurality of orifices and prints by applying energy in accordance with the print signal. In particular, the printhead 503 according to the embodiment adopts an inkjet method of discharging ink by using thermal energy. For this purpose, the printhead 503 comprises an electro-thermal transducer for generating thermal energy. Electric energy applied to the electro-thermal transducer is converted into thermal energy, and ink is discharged from orifices by using a change in pressure upon growth and contraction of bubbles by film boiling generated by applying the thermal energy to ink. The electro-thermal transducer is arranged in correspondence with each orifice, and ink discharges from a corresponding orifice by applying a pulse voltage to a corresponding electro-thermal transducer in accordance with the print signal.

As shown in FIG. 7, the carriage 502 is coupled to part of a driving belt 507 of the transmission mechanism 504 which transmits the driving force of the carriage motor M1. The carriage 502 is slidably guided and supported along a guide shaft 513 in the direction indicated by the arrow A. The carriage 502 reciprocates along the guide shaft 513 by normal rotation and reverse rotation of the carriage motor M1. A scale 508 representing the absolute position of the carriage 502 is arranged along the moving direction (direction indicated by the arrow A) of the carriage 502. In the embodiment, the scale 508 is prepared by printing black bars on a transparent PET film at a necessary pitch. One end of the scale 508 is fixed to a chassis 509, and its other end is supported by a leaf spring (not shown).

The printing apparatus has a platen (not shown) facing the orifice surface of the printhead 503 having orifices (not shown). The carriage 502 supporting the printhead 503 reciprocates by the driving force of the carriage motor M1. At the same time, the printhead 503 receives a print signal to discharge ink and print on the entire width of the printing medium P conveyed onto the platen.

In FIG. 7, reference numeral 514 denotes a convey roller driven by a convey motor M2 in order to convey the printing medium P; 515, a pinch roller which makes the printing medium P abut the convey roller 514 by a spring (not shown); 516, a pinch roller holder which rotatably supports the pinch roller 515; and 517, a convey roller gear fixed to one end of the convey roller 514. The convey roller 514 is driven by rotation of the convey motor M2 that is transmitted to the convey roller gear 517 via an intermediate gear (not shown).

Reference numeral 520 denotes a discharge roller which discharges the printing medium P bearing an image formed by the printhead 503 outside the printing apparatus. The discharge roller 520 is driven by transmitting rotation of the convey motor M2. The discharge roller 520 abuts a spur roller (not shown) which presses the printing medium P by a spring (not shown). Reference numeral 522 denotes a spur holder which rotatably supports the spur roller.

In the printing apparatus, as shown in FIG. 7, the recovery device 510 which recovers the printhead 503 from a discharge failure is arranged at a desired position outside the reciprocation range (outside the printing area) for the printing operation of the carriage 502 supporting the printhead 503. In this example, the recovery device 510 is arranged at a position corresponding to a home position.

The recovery device 510 comprises a capping mechanism 511 which caps the orifice surface of the printhead 503, and a wiping mechanism 512 which cleans the orifice surface of the printhead 503. The recovery device 510 uses a suction means (suction pump or the like) within the recovery device to forcibly discharge ink from orifices in synchronism with capping of the orifice surface by the capping mechanism 511. By this forcible discharge, the recovery device 510 achieves a discharge recovery operation of removing ink with a high viscosity or bubbles from the ink channel of the printhead 503.

In a non-printing operation or the like, the capping mechanism 511 caps the orifice surface of the printhead 503 to protect the printhead 503 and prevent evaporation and drying of ink. The wiping mechanism 512 is arranged near the capping mechanism 511, and wipes ink droplets attached to the orifice surface of the printhead 503.

The capping mechanism 511 and wiping mechanism 512 can maintain a normal ink discharge state of the printhead 503.

Figure 8:
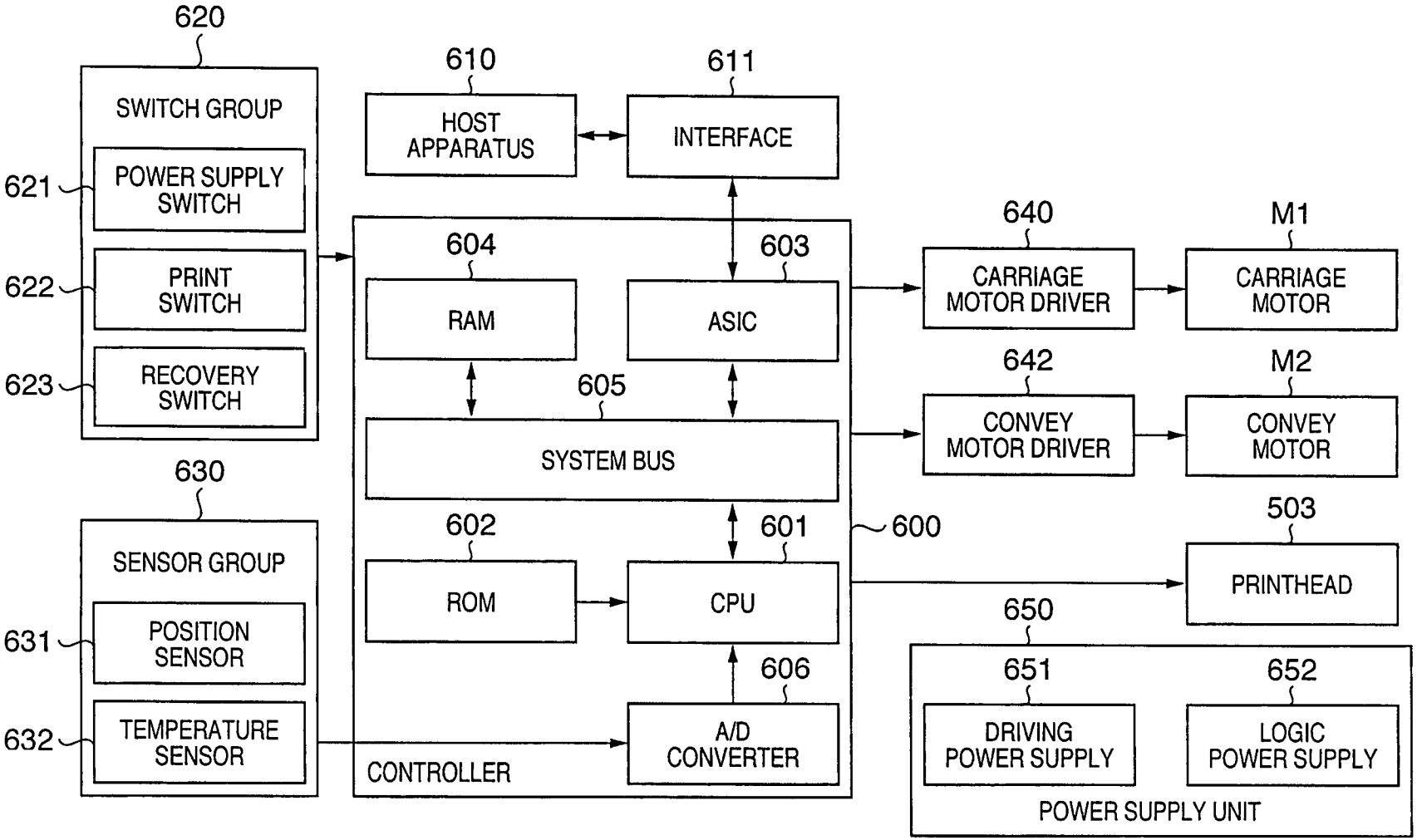
FIG. 8 is a block diagram showing the arrangement of the control circuit of the printing apparatus in FIG. 7.

FIG. 8 is a block diagram showing the control arrangement of the printing apparatus shown in FIG. 7.

As shown in FIG. 8, a controller 600 comprises a CPU 601, and a ROM 602 which stores a program corresponding to a control sequence (to be described later), a predetermined table, and other permanent data. The controller 600 further comprises an ASIC (Application Specific Integrated Circuit) 603 which generates control signals for controlling the carriage motor M1, convey motor M2, and printhead 503, and a RAM 604 having an image data expansion area, a work area for executing a program, and the like. The controller 600 outputs the DCHGX signal and the VH_ENB signal. The controller 600 receives the PS_ERR signal. A system bus 605 connects the CPU 601, ASIC 603, and RAM 604 to each other, and allows exchanging data. An A/D converter 606 receives analog signals from a sensor group (to be described below), A/D-converts the analog signals, and supplies digital signals to the CPU 601.

In FIG. 8, reference numeral 610 denotes a computer (or an image reader, digital camera, or the like) which serves as an image data supply source and is generally called a host apparatus. The host apparatus 610 and printing apparatus transmit/receive image data, commands, status signals, and the like via an interface (I/F) 611.

Reference numeral 620 denotes a switch group having a power supply switch 621, and a print switch 622 for designating the start of printing. The switch group 620 also comprises switches for receiving instruction inputs from an operator, such as a recovery switch 623 for designating start-up of a process (recovery process) to maintain good ink discharge performance of the printhead 503. Reference numeral 630 denotes a sensor group which detects an apparatus state and includes a position sensor 631 such as a photocoupler for detecting a home position h, and a temperature sensor 632 arranged at a proper portion of the printing apparatus in order to detect the ambient temperature.

Reference numeral 640 denotes a carriage motor driver which drives the carriage motor M1 for reciprocating the carriage 502 in the direction indicated by the arrow A; and 642, a convey motor driver which drives the convey motor M2 for conveying the printing medium P.

The ASIC 603 transfers driving data (DATA) of a printing element (discharge heater) to the printhead while directly accessing the memory area of the RAM 602 in printing and scanning by the printhead 503.

The inkjet printing apparatus comprises a driving power supply 651 and logic power supply 652 as a power supply unit 650. The logic power supply 652 supplies power to the controller 600 including the CPU 601, the switch group 620, the sensor group 630, and the like. The logic power supply 652 outputs a logic voltage Vcc to the controller 600. The logic power supply 652 also outputs the logic voltage Vcc to the DC/DC converter 10. The driving power supply 651 supplies power of the voltage VM to the motor drivers 640 and 642, and power of the voltage VH to the printhead 503 via the power supply control circuit.

The CPU 601, ROM, and RAM (or the controller 600 including them) in the control arrangement of FIG. 8 correspond to the control device of the electronic device (apparatus) main body.

Needless to say, various electronic devices other than the above-described inkjet printing apparatus are conceivable as an electronic device having the power supply control circuit according to the present invention.

OTHER EMBODIMENTS

The above-described logic circuit (error detecting circuit for the power supply control circuit) 14 is included in the power supply control circuit, but may be arranged in, e.g., the controller 600 in FIG. 8. The controller 600 receives the VHover signal and the VHs signal.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-295551, filed Oct. 7, 2005, which is hereby incorporated by reference herein in its entirety.

What is claimed is:

1. A power supply control circuit for controlling a power supply circuit having a DC/DC converter, comprising:

a discharge circuit configured to operate on the basis of a discharge instruction signal for instructing discharge and use a switching element to remove charges of a capacitor connected to an output terminal of the DC/DC converter;

an overvoltage detecting circuit configured to output a detection signal when a potential at the output terminal of the DC/DC converter exceeds a predetermined potential;

a level conversion circuit configured to output a signal obtained by converting a potential applied to the switching element of said discharge circuit; and a logic circuit configured to perform a logic operation between an inverted signal of a start-up signal, the detection signal, and the signal obtained by converting the potential, and output a failure detection signal representing a failed state of the power supply circuit.

2. The circuit according to claim 1, wherein the discharge instruction signal is obtained by inverting a permission signal which permits the DC/DC converter to operate.

3. The circuit according to claim 1, wherein the DC/DC converter includes a step-down (drop-down) DC/DC converter which lowers an input voltage.

4. An electronic device having a power supply control circuit defined in claim 1, comprising a controlling unit configured to check a state of a failure detection signal at least one of a timing after a DC/DC converter starts up and a timing after the DC/DC converter stops.

5. A printing apparatus for printing using a printhead, comprising a power supply control circuit defined in claim 4, wherein a DC/DC converter lowers an input voltage and outputs a voltage to be applied to the printhead.

6. The apparatus according to claim 5, wherein the power supply control circuit is arranged on a carriage supporting the printhead.

7. The apparatus according to claim 5, wherein the DC/DC converter is arranged on a carriage supporting the printhead.

8. The apparatus according to claim 4, further comprising a power supply unit configured to output voltages to the DC/DC converter and the controlling unit.

9. The circuit according to claim 1, wherein the detection signal maintains a predetermined state when the potential at the output terminal of the DC/DC converter exceeds a predetermined potential.

* * * * *

UNITED STATES PATENT AND TRADEMARK OFFICE

CERTIFICATE OF CORRECTION

PATENT NO. : 7,215,106 B2
APPLICATION NO. : 11/529230
DATED : May 8, 2007
INVENTOR(S) : Sato It is certified that error appears in the above-identified patent and that said Letters Patent is hereby corrected as shown below:

COLUMN 9:
Line 17, "(a msec)" should read -- (∝ msec) --.

Signed and Sealed this

Fourth Day of March, 2008

JON W. DUDAS
*Director of the United States Patent and Trademark Office*